United States Patent [19]

Schwam

[11] Patent Number: 4,907,382

[45] Date of Patent: Mar. 13, 1990

[54] GEODESIC DOME PANEL ASSEMBLY AND METHOD

[76] Inventor: Paul A. Schwam, P.O. Box 41267, Tucson, Ariz. 85717

[21] Appl. No.: 112,447

[22] Filed: Oct. 26, 1987

[51] Int. Cl.[4] ..... E04B 1/32

[52] U.S. Cl. ..... 52/81; 52/585

[58] Field of Search ..... 52/81, DIG. 10, 585

[56] References Cited

U.S. PATENT DOCUMENTS

| | | | |
|---|---|---|---|
| 2,057,942 | 10/1936 | Fay | 52/DIG. 10 |
| 3,660,952 | 5/1972 | Wilson | 52/81 |
| 3,691,704 | 9/1972 | Novak | 52/81 |
| 3,858,372 | 1/1975 | Wilson | 52/81 |
| 3,994,106 | 11/1976 | Grosser | 52/81 |
| 4,271,645 | 6/1981 | Crooks | 52/81 |
| 4,308,698 | 1/1982 | Fleishman | 52/81 |

*Primary Examiner*—Henry E. Raduazo

[57] ABSTRACT

A structure including a geodesic dome utilizing both strut framing members and sheathing wherein the strength of the structure is carried within the sheathing and where the strut framing cooperates to provide fastenability. The connection methods attach separate strut members to a common sheathing member and attach separate sheathing members to a common strut member. The method of structure can be panelized where the panel sheathing includes spaced tabs which overhang the panel to mate with a corresponding sheathing recess and exposed strut portions of an adjacent panel. The sheathing tabs are trapezoidal in shape of sufficient angle to allow lateral movement of panels into position without interference from overlapping tabs of adjacent panels. The interleaving panel edge configuration automatically aligns and interlocks adjacent panels into final position pending connectors. Connectors include nails, screws, or pins placed through the sheathing into the strut framework from outside the structure inwardly or inside the structure outwardly. No fasteners are placed from sheathing to sheathing or from strut to strut. A panel secondary strut layout pattern is arranged to form secondary apexes along the dihedral ridge, thus providing a positive tension and compression connection across the dihedral ridge. The introduction of a shear plate at the verticies of each panel provides additional strength by collectively forming a shear ring surrounding each apex of a completed structure.

7 Claims, 2 Drawing Sheets

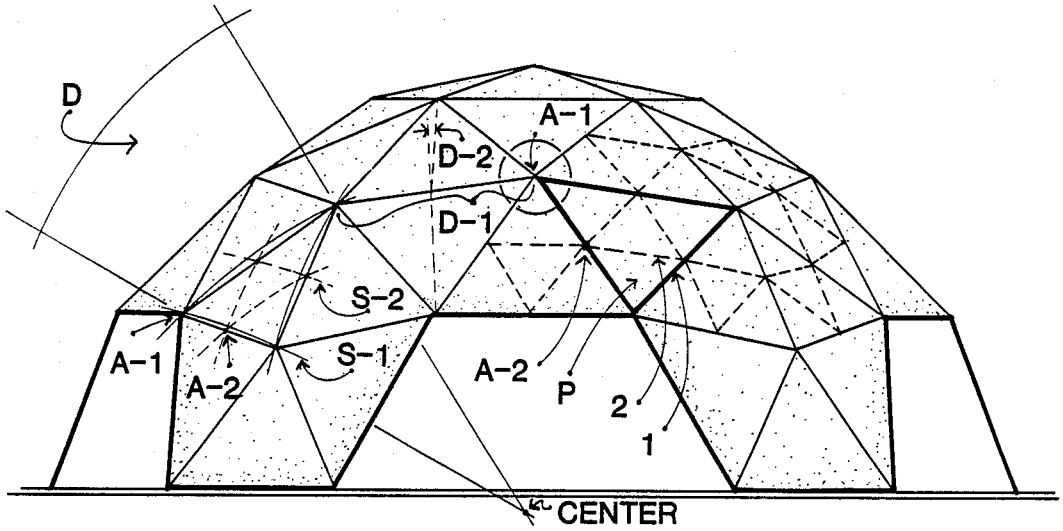
FIG. 1 DOME STRUCTURE
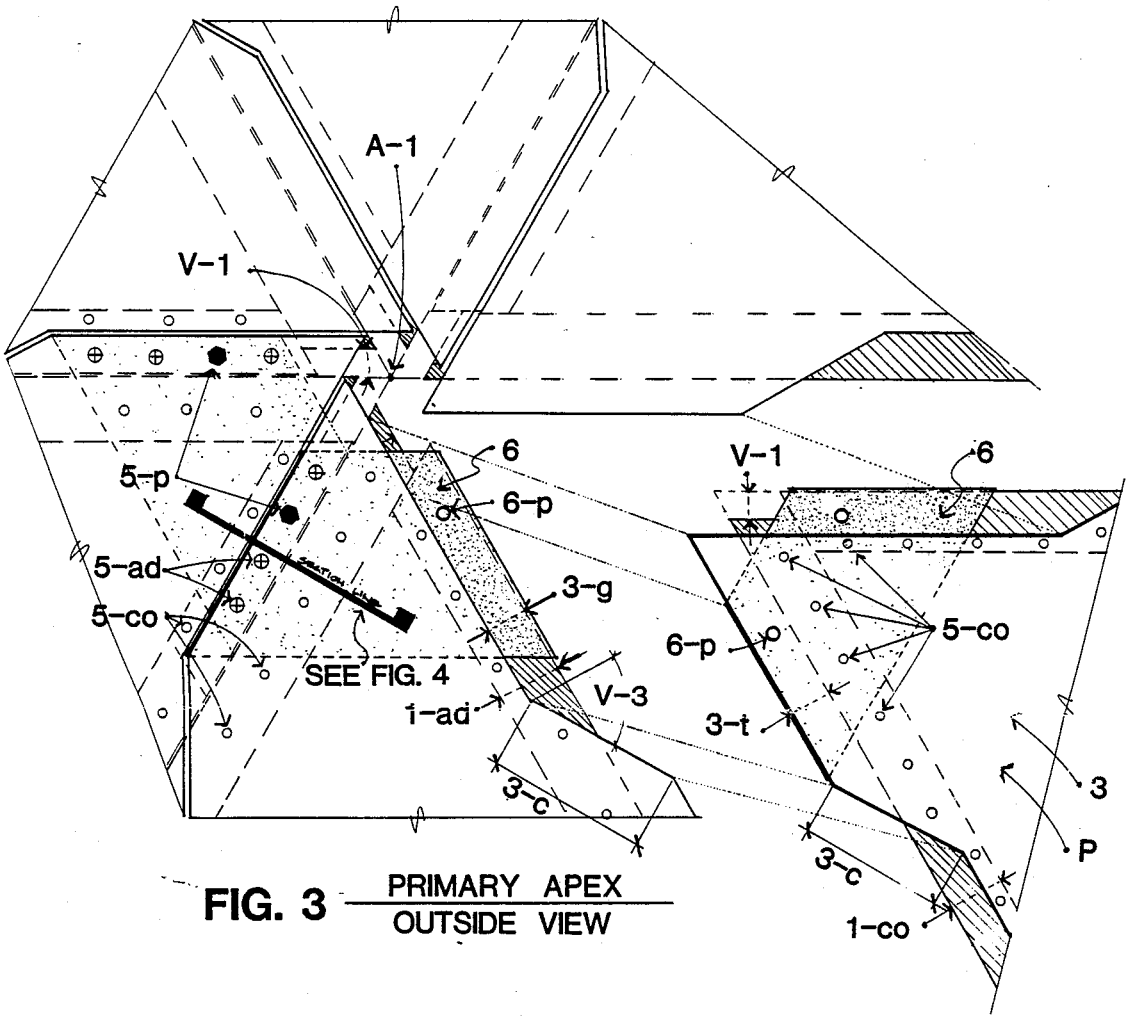
FIG. 3 PRIMARY APEX OUTSIDE VIEW

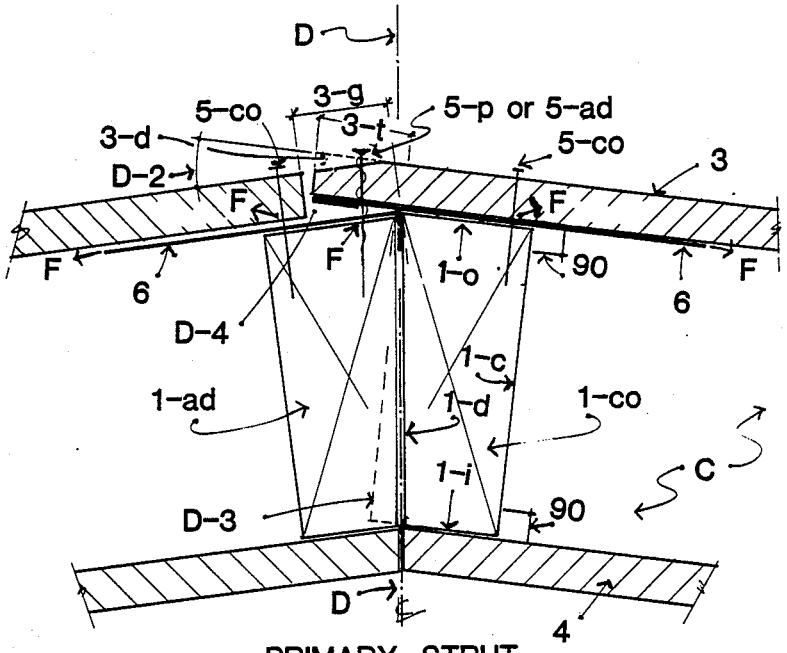
FIG. 4 PRIMARY STRUT SECTION VIEW
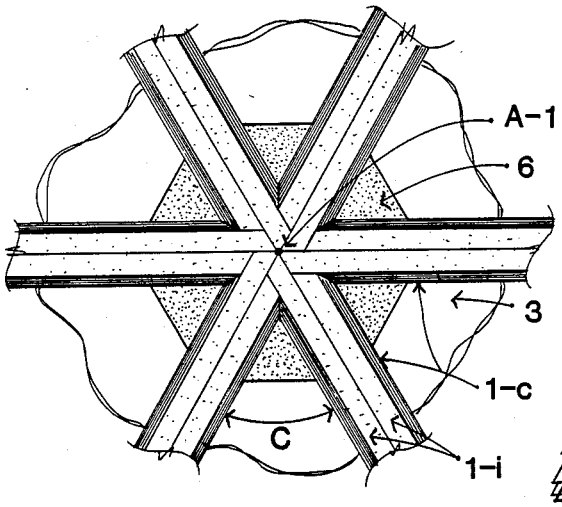
FIG. 6 PRIMARY APEX INSIDE VIEW
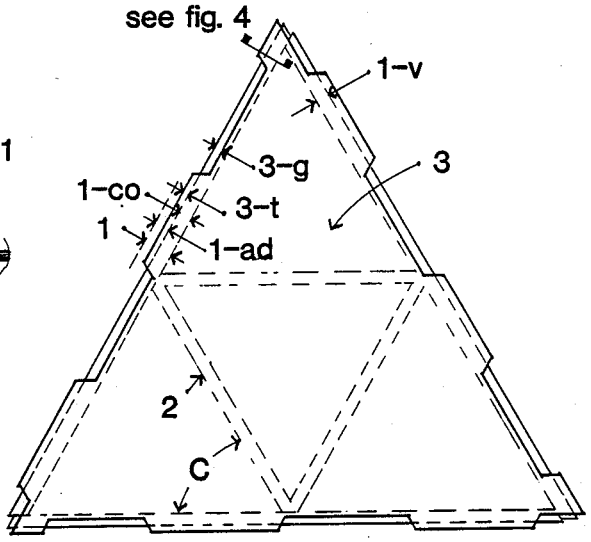
FIG. 2 TYPICAL PANEL
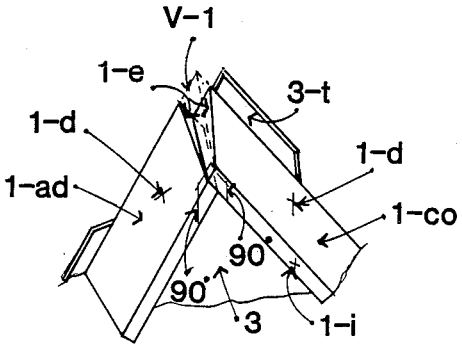
FIG. 7 PANEL VERTICE
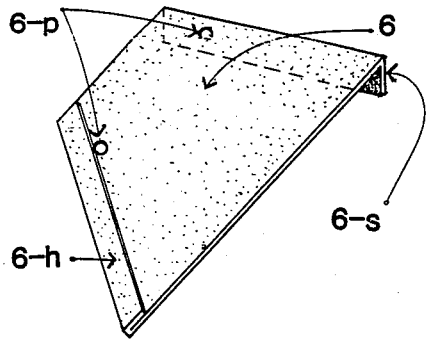
FIG. 5 SHEAR PLATE

GEODESIC DOME PANEL ASSEMBLY AND METHOD

SELECTED HISTORY OF GEODESIC DOMES

Geodesic Domes by Formal Definition

A variety of geodesic dome structures exist—by definition the outer surfaces (actual or implied) of all geodesic domes are subdivided into triangles. The outer surface of a typical individual triangle is either (1) planer, (2) simple curvature, (3) compound curvature, (4) a combination of the above.

Geodesic Domes by Structural Type

The specific structural make-up of all geodesic domes fall into one of three categories:

1. Structural frame
2. Structural skin
3. Combination of structural skin and frame (see definition of terms).

Geodesic Domes by Structural System

A clear understanding of the structural behavior of different geodesic domes is still being discovered to date. The combinations include:

1. A structural frame of straight structural segments and rigid connections implying a faceted surface.
2. A structural frame of curved structural segments implying compundly surved surface.
3. A structural frame combination of Items 1 and 2.
4. A structural skin of planer triangles forming a faceted surface.
5. A structural skin of compoundly curved triangles forming a compoundly curved surface.
6. A structural skin combination of Items 4 and 5.
7. A structural frame with cooperating skin or sheathing where the interconnecting frame or strut segments (straight or curved) provide the structural integrity and the sheathing provides lateral support (along the plane of the skin) to mid-span of the individual frame segments providing resistance to "strut slenderness" (along the plane of the skin only).
8. A structural skin with cooperating frame segments or ribs, where the structural skin, planer or curved, provide the structural integrity and the ribs provide vertical support (to or away from the center), to the skin providing resistance to "skin dimpling".

Note to #7 & #8: By providing lateral (sheathing) support along the two sides of a typical strut, and because by definition the two panels form a ridge with a dihedral angle; varying resistance to strut slenderness, to and away from the center, is achieved relative to (1) strength of the interconnection between panels along the dihedral, (2) the angle of the dihedral, and (3) the structural abilities of the cooperating sheathing itself.

GEODESIC DOMES BY FABRICATION TYPE

Fabrication techniques of geodesic domes fall in one of three major categories:

1. Complete onsite construction which converts all raw materials to finished form onsite.
2. Complete factory fabrication which converts all raw materials fo finished form offsite which is then simply transported and placed on site.
3. A combination of factory pre-fabrication and job site assembly which converts some or all raw materials to a semi-finished form offsite which is then assembled to finished form on site.

Due to the angular complexities of spherical geometry and, therefore, geodesic dome structures, factory pre-fabrication (Type (3) is largely the preferred method of fabricating finished domes.

GEODESIC DOMES BY PRE-FABRICATION SYSTEM

The popular pre-fabrication approaches can be grouped into three categories:

1. A pre-fabricated strut framework in which the struts and the strut to strut connectors are pre-fabricated offsite, then assembled onsite. The skin or sheathing, often pre-cut, is then applied to the completed dome framework onsite.
2. A pre-fabricated structural skin (which by definition requires no strut framework) is pre-fabricated offsite, then assembled onsite, utilizing a skin to skin connection method.
3. A panelized combination of frame and skin where a portion of the strut framework is pre-assembled with a portion of the skin. These assemblies consist of a framework, usually triangular, covered by a sheathing, also usually triangular. This panel pre-fabrication is done offsite, then erected onsite, ususally by interconnecting the frame members.

REVIEW OF PRIOR ART

An investigation was made into all dome structure tYpes—structural skin, structural frame, and structural combinations (panelized). The investigation revealed that the closest prior art, U.S. Pat. No. 2,682,235 (Alvin E. Miller), exists utilizing panelized structural frame with cooperating skin. The prior art consists of a skin attached to triangular frame (of half struts) later assembled via transverse bolting through the strut framework. The skin or sheathing is not integrated nor is the structural framework rigidly fixed at the apices—therefore, it is neither similar to the present inventions, nor has it structural integrity by definition of a structural frame. Other prior arts include German patents 2304722, 3418950; U.S. Pat. No. 3,660,952; Australian patent 47776. These show tab system and "overlapping" skin systems. None of these, however, utilize an alignment and interlocking tab skin/frame system as versatile and convenient as the proposed invention.

GENERAL SUMMARY OF THE INVENTION

The invention herein provides for an improved geodesic dome, novel and unique over an exceptionally wide range due to the nature of pioneering, understanding, defining, classifying, organizing and documenting previously uncharted territory.

The following is an outline of the invention's unique characteristics:

A. its structural system, structural skin with cooperating frame,
B. panel edge configuration, providing self alignment and interlocking feature,
C. panel framework layout pattern,
D. fabrication simplicity—offsite, due to cutting methods,
E. extensive and complete pre-fabrication ability due to its fastener methods,
F. use of an panel shear plate forming shear rings at final dome assembly.

The following is an outline of the objectives of the invention:

(1)—To define and establish a unique structural system in the field of geodesic dome structures, but not to be limited to the triangular assemblies of dome structures.

(2)—To provide a panelized dome sub-assembly employing the structural skin panels with cooperating frame members which assist to integrate the skin itself.

(3)—To provide a dome panel assembly which incorporates a unique "overlapping tab/gap" edge configuration.

(4)—To provide a panel cutting method which allows the simplification of panel manufacturing.

(5)—To provide an edge configuration which allows panel to panel connection method without requiring access to the panel cavity, i.e., transverse bolting.

(6)—To provide a panel with an edge configuration which allows nails or similar fasteners to be installed from the outside or inside, thereby visible to the construction regulatory agencies.

(7)—To provide an edge configuration which allows the panel cavity to be utilized if desired (install insulation) and concealed during the pre-assembly phase offsite without inhibiting the final erection process onsite.

(8)—To provide a structural system which would allow the structural sheathing to be effective whether attached to the inside, the outside, or to both sides of the cooperating framework.

(9)—To provide an edge configuration which facilitates convenient final assembly onsite by allowing the sub-assembled panels when placed approximately into position to have the weight of the panel self supported by the "tabs".

(10)—To provide a panel with an edge configuration which once placed into the approximate position, can be slid laterally toward the apex into the final position without tab to tab interference.

(11)—To provide an edge configuration which automatically interlocks the panel edges, physically eliminating the possibility of misalignment in all directions—toward the center, away from the center, and along the surface.

(12)—To provide a panel with an edge configuration which, once fixed at the vertices during assembly, automatically forces the two half strut framing members to structurally behave together in unison along the entire chord or dihedral without the use of nails or other connectors.

(13)—To provide a structural system which attains structural integrity through the sheathing and allows for liberties to be taken with the framework.

(14)—To provide a structural skin system which allows for framing material to be removed from the vertices to provide voids which facilitate the installation of wiring, etc., via transmission across or through the apices after final assembly onsite.

(15)—To provide a structural system which can easily be reinforced by the addition of simple shear plates during pre-fabrication without effecting any other objective.

(16)—To provide a fabrication method within which all compound angular cutting can be eliminated.

(17)—To provide a method of cutting panel materials which isolate and resolve central angle or dihedral angle cutting requirements into a single "dihedral plane cut". This permits simple cuts at all vertices relative to the inside, outside, or cavity side surfaces of all typical half struts.

(18)—To provide a method of cutting panel materials which makes simple relationships between each and every component part, automatically eliminating the need for compound cutting.

(19)—To provide a structural system/strut layout pattern where secondary struts subdivide the primary strut triangle into four identical smaller triangles, improving the overall strength by reducing the span of the primary struts and provides a backup to the panel sheathing for dihedral support. This allows for greater flexibility of panel sheathing removal for skylights, etc., without sacrificing strength.

(20)—To provide a strut layout pattern design which subdivides the primary strut triangle cavity into four identical smaller cavities to assist in manufacturing standardization of infill materials (insulation, etc.).

(21)—To provide a method of cutting panel materials in which a panel cavity is created whose cavity sides are 90° to the panel surface.

(22)—To provide a structural system/panel design in which all critical fastening devices** (nails, etc.) required during offsite sub-assembly and during onsite final assembly are clearly inspectable after final assembly.

** Critical fastening devices often require inspection and certification by national building regulatory agencies.

BRIEF DESCRIPTION OF THE DRAWINGS

FIG. 1 is an exterior elevation view of a typical geodesic dome constructed of pre-fabricated triangular panels of the present invention. FIG. 1 identifies a typical triangle pannel assembly P, a typical primary apex A-1, a typical dihedral plane D, a typical dihedral ridge D-1, a typical dihedral angle D-2, a typical primary strut 1, and a typical secondary strut 2, a typical secondary apex A-2, the hypothetical primary outer sphere S-1, and the hypothetical secondary inner sphere S-2. The center C of both the dome and hypothetical spheres.

FIG. 2 is an enlarged exterior detail view of a complete triangular panel P.

FIG. 2 identifies a vertex V, half primary struts 1.co & 1ad, secondary (intermediate) struts 2, panel sheathing 3, panel/sheathing tabs 3-t, panel/sheathing gaps 3-g, cooperative half strut 1-CO,* adjacent half strut 1-ad,* another half strut completing a vertice 1-v and a typical cavity space C between the strut framework members.

*Reference relative to example panel assembly "A".

FIG. 3 is an enlarged exterior view of a typical apex as shown in FIGS. 1 and 2.

FIG. 3 illustrates the vertice of a typical panel assembly as it is placed into final position during dome assembly.

FIG. 3 identifies a typical panel vertice V, a primary dome apex A-1, a typical "tab" portion of the exterior skin or sheathing 3-t,* a typical gap of an adjacent panel assembly 3-g, a tab to gap sheathng transition area 3-c, a typical cooperative half strut 1-co,* a typical adjacent half strut 1-ad,* a typical area of overlap of tab and adjacent gap 3-g,* a typical assembly clearance angle V-3 transition between tab and gap portions of the sheathing at the edge of a panel typical fastner (nail or screw) 5-co connecting sheathing to a cooperating half strut, a typical fastener 5-ad, connecting sheathing to an adjacent half strut, a typical drift pin fastener 5-p, connecting sheathing to an adjacent half strut in the area of an apex, a typical drift pin alignment holes 6-d, and typical "vertice void" V-1.

*Reference relative to example panel assembly "A".

FIG. 4 is a cross-section, as shown in FIGS. 2 and 3, through the dihedral ridge, D-1, as shown in FIG. 1.

FIG. 4 identifies the sheathing of a panel assembly, 3, the tab portion at the edge of the sheathing, 3-t, of a typical panel assembly, the "gap" portion of the sheathing 3-g, of the adjacent panel assembly, a cross-section through a cooperative half strut, 1-co,* a cross-section through an adjacent half strut, 1-ad,* a typical panel cavity area, C, a typical sheathing tab dihedral bevel, 3-d, dihedral void D-4 a typical half strut dihedral bevel, D-3, typical interior sheathing, 4, the "inside face" of a typical half strut, 1-i, the "outside face" of a typical half strut, 1-o, the "cavity side face" of a typical half strut, 1-c, the "dihedral side face, of a typical half strut, 1-d, the typical 90° angle relationship between the cavity side face and the inside and outside (sheathing) planes the material removed from a rectangular half strut to achieve the required dihedral angle, D-3, and the material removed from a typical tab to achieve a co-planer surface along the dihedral ridge, 3-d, the dihedral angle D-2, a typical fastner (nail or screw) 5-co) connecting sheathing to a cooperating half strut, a typical fastener 5-ad, connecting sheathing to an adjacent half strut, a typical drift pin fastener 5-p, connecting sheathing to an adjacent half strut in the area of an apex.

FIG. 5 is a perspective view of a typical shear plate or additional sheating means 6 located at the vertices of a typical panel assembly as shown in FIGS. 3 and 4.

FIG. 5 shows a "hemmed" edge to resist shear plate or additional sheating means tearing, 6-h, and a "shouldered" edge 6-s, a typical draft pin hole 6-p.

FIG. 6 is an inside perspective view of a typical panel assembly vertice.

FIG. 6 identifies a typical half strut 1-co, the underside of typical sheathing tab 3-t, the dihedral side of a typical strut 1-d, the inside face of a typical half strut, 1-i, the 90° relationship of the end cut surface to cavity side surface of the typical half strut, 1-co, the "end cut" surface of a typical half strut 1-e, the wedge shaped "vertice void" V-1 created when a 90° end cut is employed at the intersection of two dihedral side side surfaces (a compound angle end cut situation).

FIG. 7 is an inside perspective view of a typical dome vertice with the absence of an interior sheathing and the half struts exposed.

FIG. 7 identifies a primary apex A-1, the cavity side face of the half struts 1-c, the inside face of the half struts 1-i, the inside surface of the exterior sheathing of a typical panel assembly 3, the inside exposed portion of a typical shear plate or additional sheating means 6, in place after final dome assembly and a typical panel cavity C.

DESCRIPTION OF THE INVENTION

The description presented herein describes several improvements to the conventional methods of fabricating a geodesic dome structure. More specifically, the invention described is an improved version of a panelized, triangular, skin-strut sub-assembly to a geodesic dome.

In the present invention, the broadest of its novel physical characteristics is its use of a skin or exterior sheathing as the primary structure in cooperation with a triangulated framework. The framework provides only a secondary function, to facilitate the integration of the panel sheathing across the dihedral. The panel to panel connection is made without overlapping the skin structure and without directly connecting the frame structure together or the skin structure together.

FIG. 1 illustrates a typical triangle (panel) assembly P and an adjacent typical triangle (panel) assembly in final position as components of a completed geodesic dome, the two panels are connected along a typical dihedral plane D. In the enlarged FIGS. 3 and 4, it is shown that there is no seam in the structural sheathing directly along the dihedral line. The structural sheathing 3 of Panel P overlaps and is attached with fasteners 5-ad to the framing member 1-ad of the adjacent panel. This connects the panels in tension along the entire dihedral plane D. The corresponding half struts 1-co & 1-ad of adjacent panels butt together along their dihedral surfaces 1-d to provide additional compression strength across the dihedral plane D. The panel sheathing 3 acting as a continuous plane aided by its mutual connection via fasteners 5-ad and a common half (primary) strut or intermediate (secondary) strut 2, to provide all the tensile and compressive strength required for a stable dome. It is to be noted that the vertice voids V-1 occur at the apexes A-1 of the dome. See FIGS. 3 and 6. These voids in the frame structure do not affect the dome's structural performance as the stresses are carried within the skin or sheathing.

Also to be mentioned is that the frame structure or half struts 1co+1-ad are not directly interconnected to one another in any way. The dome frame system, half struts 1-co+1-ad, and intermediate struts 2 are critical, however, as a bridging device along the seams or edges of the sheating panels.

For descriptive purposes, the structural system of the present invention will be identified as a panelized structural skin with cooperating frame system. This is not to be confused with skin to skin connection systems or non-panelized skin over structural frame systems.

The present invention structure and technique of using the framework only to facilitate the continuous interlocked panel skin feature rather than to provide compressive and tensive forces within a dome, is a substantial departure from the teachings of the prior art. In the present invention, a unique panel assembly edge configuration not only allows the use of the panelized structural skin with cooperating frame system, described above, but also serves as an automatic alignment and interlock device during dome assembly, additionally, the panel edge configuration unifies the structural behavior by interlocking the half struts together along with the dihedral without the use of fasteners.

The panel edge configuration is best shown in FIGS. 2, 3 and 4 where the perimeter of the panel sheating 3 of typical panel assembly P undulates both beyond and short of the dihedral plane D at the outside edge of its cooperating half strut 1-co. Undulations beyond the dihedral plane D from tabs 3-t. Undulations short of the dihedral plane D form gaps 3-g. Each tab 3-t extends apex 1" beyond the dihedral plane D of its cooperating half strut 1-co, and is attached to its cooperating half strut 1-co by nail or screw fasteners 5-co. Each gap 3-g falls approximately 1" short of the dihedral plane D of its cooperating half strut 1-co and thereby exposes approximately 1" of the outside surface of its cooperating half strut 1-co in the region of the gap 3-g. The panel sheathing tab 3-t overlaps the exposed portion of adjacent half strut 1-ad in the gap region and is attached to that adjacent half strut by a nail or screw fastener 5. During final dome assembly, the dihedral side surfaces 1-d of a typical cooperating half strut 1co a typical adjacent half strut 1-a are joined face to face along the dihedral plane D forming one complete primary strut 1.

During the final assembly, the tabs 3-t of a typical panel assembly P overlap the exposed outside surface 3-g of an adjacent half strut 1-a and is rigidly attached by screw or nail fasteners 5 to the adjacent half strut 1-a. Due to the dihedral angle D-2 panel sheathing materials is removed from the outside edge of all panel tabs 3-t to form a tab bevel 3-d plane which is co-planner with the plane of the adjacent panel sheathing surface along the dihedral ridge D-1.

During final dome assembly, the automatic alignment and interlocking feature occurs due to the tab 3-t to gap 3-g overlap feature which alternates from panel assembly P to an adjacent panel assembly several times, which interleaves the panel sheathing tabs 3-t along the length of the dihedral ridge D-1. The interleaved tab structure prevents either of the panel assembly's edges from independently moving inwardly or outwardly. (See FIG. 4) If the typical panel assembly P is urged inward, the overlapping tab 3-t from the same panel assembly will physically contact the exposed portion of the adjacent half strut 1-ad in the gap region 3-g and thereby cause the adjacent half strut (1-ad) to move inwardly also. Similarly, if the typical panel assembly P is urged outward, the cooperating 1-co will physically contact the overlapping tab of the adjacent panel assembly, causing it to move outwardly also.

Once the individual panels are in final dome assembly position, the automatic panel alignment feature also exist laterally across the panel surfaces due to the undulating tab 3-t 3-g profile of the panel sheathing 3 along the dihedral ridge D-1. Due to the undulating perimeter edge of the panel sheathing, lateral sliding between two panels assemblies is restricted by physical contact in the tab to gap transition areas 3-c of the panel sheathing between adjacent and panel assemblies.

The final result of the undulating panel edge configuration and the interlocked panel tab to half strut feature is the two adjacent panel assemblies are automatically placed into alignment and physically interlocked in all directions without fasteners.

It should be noted that since the panel assemblies do interlock in final position, the only method of placing the last panel assembly P into final position is to slide panel assembly P laterally toward apex A-1. A typical assembly clearance angle V-3 at the transition area between tab and gap portions of the panel sheathing is necessary to avoid tab to tab interference during final assembly.

It should also be noted drift pin alignment holes 6-p can be placed through the tab 3-t and into the adjacent half strut 1-ad; located to assist in assembly alignment. Drift pins or lags 5-p are inserted in the same manner as standard screw or nail fasteners from the outside inward, or from the inside outward, but not laterally across the surface.

The present invention identifies and forms a unique framework layout pattern pertaining largely to the secondary or intermediate strut members.

To understand this feature, it must be appreciated that all of the apexes of the dome formed by the primary strut segments occur at the surface of a hypothetical sphere called the "greater sphere" or "primary sphere" S-1. (See FIG. 1) In a geodesic dome formed of planer triangle segments, the primary struts 1 and, therefore, the dihedral ridges D-1, span from A-1 to apex A-1 inside the surface of the greater sphere. The present invention has three secondary struts 2 per typical triangle panel assembly P. The ends of these secondary struts are joined to form a triangular "secondary frame" whose vertices are tangent with the midpoint of the half (primary) struts 1 of typical panel P.

The secondary strut arrangement serves two purposes, best illustrated by FIG. 1. First, to support the half (primary) struts at their mid span, secondly, the secondary strut arrangement forms an independent geodesic structural network. As the (primary) triangle panel assemblies come together, the vertices of adjacent secondary frames also align and join together across the midpont of the dihedral ridge D-1. The secondary strut framework 2 forms a secondary geodesic framework with secondary apices located at the hypothetical surface of an "inner sphere" or "secondary sphere" S-2.

The unique feature of a primary "outer sphere" framework supported by a secondary "inner sphere" framework results in the distribution of loads not only across the planes of the "outer sphere" structure but also across the struts of the "inner sphere" structure.

Since secondary framing is often necessary during construction to support interior finish materials, an economy is realized by making necessary framing members also structurally significant framing members.

It should be noted that the secondary framing members, similar to the primary framing members (half struts) employ the same fasteners and installation methods as described in the present invention. The secondary framing members along with the framing members need no interconnecting fasteners. Should the panel sheathing to strut fasteners be removed from the dome structure described in the present invention, all framing members, primary and secondary, would immediately disintegrate.

In the present invention, by relying upon the structural skin with cooperating framework; the use of a secondary framework can be described as a thickening of the skin structure as it reinforces the structural skin against buckling across the surfaces of the skin or sheathing.

The present invention incorporates a panel framework design formulated in response to the unique cooperative structural system and the unique panel edge configuration. The frameowrk is novel not only by its structural performance and by its layout pattern, but also by its individual frame member cutting or manufacturing formula.

As previously described of the inventions performance, the structural integrity and strength of the present invention is resolved within the skin. As also described in the present invention, there is no need for fasteners between individual frame members. Therefore, the present invention can and does create a nonstructural vertice void in the framework at an otherwise critical apex location of a dome structure. It is best shown in FIG. 6, that the two sides of intersectng dihedral side surfaces 1-d at the panel vertice necessarily form a complex angle cut situation illustrated by the wedge shaped vertice void V-1. The end cut may be cut 90° to the cavity side surface as shown, which creates the vertice void V-1 only because the void is not critical in this unique structural system as explained earlier in the description of the invention.

The void facilitates the installation and transmission of wiring, etc., from panel to panel across and through the apex after final dome assembly. The vertice void V-1 can be best seen in FIG. 6. It occurs at the intersection of two typical half struts at the vertice of a typical panel. The vertice void is the result of employing a simple 90° cut to the end of a typical half strut 1-e as shown. A half strut end, 1-e in this position, at the intersection of two dihedral side faces 1-d of two typical half struts is a complex angle situation usually requiring a complex half strut end cut.

It should be noted in FIG. 6, the vertice void V-1 is not visible from the inside of the dome apex A-1.

It should be noted in FIG. 3, the vertice void V-1 is visible from the outside of the dome apex A-1.

In the present invention, a unique frame member cutting formula is also used to simplify the panel manufacturing process. The entire framework can be fabricated entirely using simple angle cuts for a geodesic dome structure, which by its definition of spherical geometry is composed entirely of complex angles.

The key to the frame cutting formula is the dihedral side 1-d bevel, best shown in FIG. 4.

FIG. 4 shows the dihedral side 1-d face of a typical cooperative half strut 1-co co-planer to the dihedral side 1-d face of an ajdacent half strut 1-ad. The dihedral side bevel compensates for the required dihedral angle D-2. All remaining contact surfaces within a panel assembly have at least one parallel or 90° angle relationship to each and every other adjacent surface. (See FIG. 4). The outside panel sheathing 3 is parallel to the outside surface 1-o and 90° to the cavity side surface 1-c of its cooperative half strut 1-co. Similarly, the inside panel sheathing surface 4 is parallel to the inside surface 1-i, and 90° to the cavity side surface 1-c of its cooperative half strut 1-co. Similarly, as shown in FIG. 6, at a typical vertice, the half strut 1-ad end cut 1-e which abuts the cavity side surface 1-c of the adjoining half strut 1-co is 90° to the surface 1-0 of a typical half strut 1-co are parallel with each other and perpendicular to the cavity side surface 1-c. The dihedral side surface 1-d angled relative to the overall dome dihedral angle, D02 not relative to the panel assembly. Since all cavity side surfaces 1-c are 90° to all sheathing side scan be described in another way. (See FIG. 4). The inside surface 1-i and the outside surfaces 1-i & 1-o then all subsequent subdivisions with the panel cavity, i.e., insulation and secondary struts, can be produced with a 90° relationship to the panel surface 1-i and cavity side surface 1-c of the half strut.

The present invention uses a fastener placement method whereby all nail, screw, or other fastening devices used for all assembly procedures, onsite and offsite, are placed from the outside inwardly, or from the inside outwardly, or both. This fastener method facilitiates assembly and/or dis-assembly of a closed panel cavity by not requiring transverse connectors, directly through the framework, originating and/or terminating within the panel cavity.

The advantage of a fastener placement accessible from the inside or outside surface is their convenient removability or their convenient inspectability after final assembly.

The connector placement direction is best illustrated in FIG. 4, showing the nail or screw connectors originating from either the inside or outside of the dome; penetrating through the inner or outer panel sheathing 3, or 4 respectively, and penetrating into the adjacent inside or outside 1-i or 1-o surfaces of the typical half struts.

It should be noticed that no lateral or transverse fasteners interconnect the half struts directly. Notice the fastener placement method of both the panel pre-assembly process as well as the dome final assembly processes—locate the connectors in the same fashion. FIG. 4 illustrates a typical connection 5-co penetrating the exterior sheathing 3 into a cooperative half strut 1-co as well as an adjacent half strut 1-ad in the same direction, from the outside inwardly.

The present invention includes a pre-placed shear plate located precisely at the optimum location for the particular structural system of the present invention itself.

The shear plate or additional sheating means is trapezoidal in shape, see FIG. 7. The typical shear plate or additional sheating means 6 is located at each panel vertice between the outside surfaces of the panel half strut framework 1-o and the inside surface of panel sheathing 3 as shown in FIGS. 3 and 4.

The placement of the shear plate or additional sheating means 6 during panel pre-assembly utilizes the same panel sheathing to half strut fasteners 5-co in the same manner. The location of the shear plate or additional sheating means 6, hidden between the panel sheathing and the half struts, provides an outside nailable sheathing surface in the regions with the shear plate or additional sheating means. The addition of the shear plate or additional sheating means requires no additional fasteners.

The specific shape of the shear plate or additional sheating means 6 as shown in FIG. 5 has an inward 90° shoulder 6-s and an outward 180° hem 6-h. As shown in FIG. 4, the inward 90° shoulder 6-s conveniently shoulders the adjacent half strut 1-ad which has the tendency to shear laterally. The outward hem fits conveniently inside the wedge shaped dihedral void D-4, formed between a typical panel sheathing tab 3-a and an adjacent half strut 1-ad. The hem is used due to the fact that the sheathing tab dihedral bevel 3-d removes the majority of shoulderable material.

The shear plate or additional sheating means transfers the stresses of this specific structure skin design precisely along the lines of stress. FIG. 4 illustrates the path of stress forces F transferred from the sehating of typical panel P to the typical nail or screw fasteners 5-ad penetrating the tab 3-t and adjacent half strut 1-ad. The stress F travels from the shear plate or additional sheating means of Panel P to the shear plate of an adjacent panel by common connection through a typical fastener. From the shear plate or additional sheating means of the adjacent panel, the stress continues both through the plate to the next adjacent shear plate or additional sheating means and into the sheathing of the adjacent panel.

The final collective configuration and performance of all the shear plates or additional sheating means at a typical apex A-1 is a shear ring made up of overlapped shear plates or additional sheating means 6. The shear ring's structural effectiveness relies only on the shear plates or additional sheating means 6 themselves and the common fasteners 5-ad. The panel half struts and sheathing provide shear plate or additional sheating means positioning assistance only.

This unique position relationship can be seen in FIG. 4 (assuming the absence of an interior sheathing and the respective fasteners as shown) within the region of the half struts and across the dihedral ridge. There are absolutely no lateral structural continuities either inside or outside of the plane of the shear plate or additional sheating means 6. There are no additional transverse fasteners interconnecting either the framework or the sheathing. Any compressive continuity due to directly abutting half strut frame components is incidental. Without the panel the sheathing and their respective fasteners, the half strut framework forming the dome would immediately disintegrate.

I claim:

1. A plurality of panels for constructing a multifaced geodesic dome each panel comprising:

(a) a plurality of strut means arranged end to end to define a first polygonal shape, said shape having outer edges substantially identical to one face of said geodesic dome, and (b) a sheating means secured to said strut means; and having a plurality of edges definding a second polygonal shape which approximates said first shape, each edge of said second polygonal shape having first portions which project beyond said outer edges of said first polygonal shape and second portions which terminate short of said outer edges; where by when panels are placed adjacent one another to form the faces of said multifaced geodesic dome each panel will have the first portions project across the outer edges of adjacent panels, which portions may be secured to the strut means of an adjacent panel to form said geodesic dome.

2. The plurality of panels of claim 1 where in said first portions comprise a series of tabs and where in said second portions comprises a series of gaps.

3. The plurality of panels of claim 1 where in each said panel has a boundary defined by said first and second portions the boundry of said sheating changes direction between said first portion and said second portions at an angle no more than 30 degrees from parallel to nearest said strut.

4. The plurality of panels of claim 2 where in holes are provided in said tabs and in said struts in the area of said gaps for driven fasteners.

5. The plurality of panels of claim 4 where in the said holes in said tabs and said holes in said strut in the area of said gap are located to come into alignment with each other when panels are placed adjacent to one another to form the faces of said multifaced geodesic dome.

6. The plurality of panels of claim 1 or 5 where in an additional layer of sheating means is placed between said struts and said sheating and extends to the outer edge of said sheating or to the outer edge of said strut, whichever projects the furthest.

7. The plurality of panels of claim 6 where in holes are provided in the additional layer of sheating which correspond to the holes in the said struts and said tabs.

* * * * *